United States Patent [19]

Wendt et al.

[11] Patent Number: 4,942,077

[45] Date of Patent: Jul. 17, 1990

[54] TISSUE WEBS HAVING A REGULAR PATTERN OF DENSIFIED AREAS

[75] Inventors: Greg A. Wendt, Neenah; Kimberly K. Underhill, Appleton; James S. Rugowski, Appleton; Bernhardt E. Kressner, Appleton, all of Wis.; Kai F. Chiu, Brandon, Miss.

[73] Assignee: Kimberly-Clark Corporation, Neenah, Wis.

[21] Appl. No.: 355,960

[22] Filed: May 23, 1989

[51] Int. Cl.[5] ..... B32B 5/14

[52] U.S. Cl. ..... 428/152; 162/111; 162/113; 162/117; 428/153; 428/171

[58] Field of Search ..... 428/152, 167, 171, 153; 162/113, 111, 117

[56] References Cited

U.S. PATENT DOCUMENTS

| | | | |
|---|---|---|---|
| 3,230,136 | 1/1966 | Krake | 162/111 |
| 3,905,863 | 9/1975 | Ayers | 162/113 |
| 3,974,025 | 8/1976 | Ayers | 162/113 |
| 4,102,737 | 7/1978 | Morton | 162/113 |
| 4,191,609 | 3/1980 | Trokhan | 162/113 |
| 4,440,597 | 4/1984 | Wells et al. | 162/111 |
| 4,441,962 | 4/1984 | Osborn III | 162/111 |
| 4,529,480 | 7/1985 | Trokhan | 162/109 |

*Primary Examiner*—Marion C. McCamish
*Attorney, Agent, or Firm*—Gregory E. Croft

[57] ABSTRACT

Creped tissues having improved perceived softness and appearance are made from tissue webs having at least a machine direction broken line pattern of individual densified areas containing higher mass concentrations of fibers. The broken line pattern of densified areas creates a pleasing appearance and influences the creping to provide a more uniform crepe and hence improved tissue softness.

14 Claims, 4 Drawing Sheets

TISSUE WEBS HAVING A REGULAR PATTERN OF DENSIFIED AREAS

BACKGROUND OF THE INVENTION

In the making of tissue products, such as facial tissues, tissue manufacturers are constantly striving to improve the quality and consumer acceptance of their products. Most efforts have been directed toward increasing softness while maintaining adequate strengths. Other properties such as bulk and absorbency have also been of interest; however, very little effort has focused on visual appeal, although it is known that visual properties can affect the user's perception of the softness of a tissue. For the most part, conventional wisdom in the industry is to address this aspect by making tissues which have a more uniform formation.

SUMMARY OF THE INVENTION

It has now been discovered that the desirability of a tissue web can be improved by imparting to the tissue web a regular pattern of individual optically densified areas containing higher mass concentrations of fibers. These individual densified areas are created during the initial formation of the tissue web and can be attributed to the drainage pattern of the forming fabric, hereinafter described, which causes the fibers to be retained by the fabric in a regular distinct pattern of individual densified areas corresponding to zones of high drainage rates. These individual densified areas are arranged in one or more series of regularly-spaced parallel broken lines, each series appearing somewhat like parallel strings of pearls, with the pearls being the individual densified areas. At least one of the series of regularly-spaced broken lines (herein referred to as a "broken line pattern") has broken lines aligned with the machine direction of the web. Because the individual densified areas making up each line are separated from each other by areas having a lower mass concentration of fibers, each line has a discontinuous appearance and is referred to as a "broken" line. The resulting broken line pattern is detectable in the finished product, even after creping. Although the individual densified areas themselves may not be readily recognizable by the casual observer, the presence of a broken line pattern imparts a more pleasing appearance to the tissue and is detectable by the Lunometer Test (hereinafter defined). Preferably, the machine-direction broken line pattern is accompanied by the presence of at least one diagonal broken line pattern and/or a cross-machine direction broken line pattern, which in combination with the machine-direction broken line pattern renders a tissue having a woven look similar to a linen handkerchief. Visually, the machine-direction broken line pattern predominates, but its appearance is softened by the presence of other broken line patterns. In any case, the presence of the individual densified areas also substantially influences the downstream creping operation to the extent that the resulting tissue product has a unique, more uniform crepe structure than conventional products as evidenced by the low standard deviation of the crepe angle (hereinafter defined). The resulting more uniform crepe structure gives the tissue web improved softness and increased consumer preference.

Hence, in one aspect, the invention resides in a tissue web having at least one broken line pattern of individual densified areas which contain higher mass concentrations of fibers and which are created during the initial formation of the tissue web, said web exhibiting a positive response to the Lunometer Test for the machine direction of the web and having a standard deviation for the sine of the crepe angle of 0.18 or less. In a preferred embodiment, the broken lines of individual optically densified areas running in the machine direction are preferably spaced apart about 0.03 inch center to center. The densified areas themselves are approximately 0.01 inch wide and from about 0.3 to about 1 mm. in length. However, the size and shape of the individual densified areas and the spacing of the broken lines will depend on the nature of the fibers and the weave of the forming fabric as hereinafter described. Preferably, the crepe structures of the tissue webs of this invention are characterized, in addition to the low standard deviation of the crepe angle, by a sine of the crepe angle of from about 0.6 to about 0.5. The crepe leg length is preferably from about 100 to about 120 micrometers, most preferably about 110 micrometers, with a standard deviation of about 50 or less. The crepe amplitude is preferably from about 50 to about 60 micrometers, most preferably about 55 micrometers, with a standard deviation of about 20 or less.

In another aspect, the invention resides in a tissue web having at least two broken line patterns of individual optically densified areas containing higher mass concentrations of fibers created during the initial formation of the tissue web, said tissue web exhibiting a positive response to the Lunometer Test for the machine direction and a diagonal direction of the tissue web. The tissue may also exhibit a positive response to the Lunometer Test for the cross-machine direction of the web.

In a further aspect, the invention resides in a method for making a tissue web comprising: (a) continuously depositing an aqueous slurry of papermaking fibers onto an endless forming fabric comprising warp yarns and shute yarns; (b) draining water from the slurry through the forming fabric to form a dewatered web, wherein papermaking fibers are retained on the forming fabric in a broken line pattern of individual densified areas arranged in broken lines parallel to the machine direction of the web, said broken lines being spaced apart a distance greater than the average spacing of the warp yarns of the forming fabric; (c) drying the dewatered web; and (d) creping the web. Preferably, the papermaking fibers are retained on the forming fabric in a manner exhibiting at least two broken line patterns, wherein one broken line pattern contains broken lines parallel to the machine direction of the web and another broken line pattern contains broken lines aligned diagonal to the machine direction of the web or parallel to the cross-machine direction of the web.

Products in accordance with this invention can be characterized at least in part by their positive response to the Lunometer TM Test, hereinafter described, which detects the presence of a regular optical line pattern in a pre-selected direction. The Lunometer Test utilizes a lunometer, which is a well-known device used in the textile industry to characterize the mesh or count of fabrics, the function of which is based on a naturally occurring phenomenon known as the Moiré Principle. The lunometer simply consists of a clear plastic rectangular plate containing a series of fine black lines, which in some lunometer styles are parallel but of gradually differing spacing, while in other styles are gradually diverging. A corresponding numbered scale is printed along the long edge of the plate for both styles. When the lunometer is placed on top of a test surface having a regular line pattern, such as a woven fabric, light passing through the lunometer's lines interferes with the line pattern of the test surface, producing a visible wave pattern. The point(s) where the line of symmetry of the wave pattern (refer to the Drawing) intersects the lunometer numbered scale represents the line pattern frequency and is referred to herein as the Lunometer Index. For purposes of this invention, the Lunometer Index represents the number of broken lines of individual densified areas per inch of tissue in the machine direction, diagonal direction or crossmachine direction (A diagonal direction is any direction falling between the machine-direction and the cross-machine direction). It is preferred that the tissue webs of this invention have a Lunometer Index of about 70 or less, and most preferably from about 35 to about 65, in the machine direction. It is more preferred that the tissue webs of this invention also have a Lunometer Index of about 60 or less, and most preferably from about 15 to about 45, in a diagonal direction.

A lunometer for use in the Lunometer Test described herein must be able to detect patterns of about 70 lines per inch or less. A suitable lunometer is Model F, available from John A. Eberly, Inc., P.O. Box 6992, Syracuse, N.Y. 13217, which is capable of detecting 25–60 lines per inch. If the tissue contains more than 60 or less than 25 lines of densified areas per inch, a lunometer having a scale beyond 60 or less than 25 would be necessary.

To conduct the Lunometer Test, a single ply of a tissue web to be tested is relaxed in a water bath to remove any creping or embossing patterns which are present. Relaxation is accomplished by floating a single ply of the tissue to be tested on the surface of a 50° C. deionized water bath for 10 minutes. Thereafter the tissue is carefully removed from the bath and dried. A particular set-up found useful for this purpose includes: a 12 inch×17 inch container for the water; an 11 inch×15 inch Lexan® frame covered with a stainless steel wire screen (100×100 mesh, 0.0045 inch wire diameter); a 10 inch×14 inch phosphor bronze wire screen (90×90 mesh, 0.005 inch wire diameter); and a Valley Steam Dryer (handsheet dryer) having a convex drying surface of about 16 inches×16 inches and a canvas cover held down by a 16 inch long 3675 gram weight. The Lexan frame covered with the stainless steel screen is placed into the water bath with the screen two inches below the surface of the water. For samples that sink, the water depth above the screen should be the minimum necessary to momentarily float the sample (about ¼ to ½ inch). Any pockets of air trapped under the screen surface are released. The bronze wire screen is placed on top of the stainless steel screen, the latter providing support and stability for the bronze wire screen and tissue during the procedure. The tissue sample is then floated on the surface of the water bath for 10 minutes. At that point the frame, bronze wire screen and tissue sample are evenly and carefully lifted out of the water. The tissue, which is supported by the bronze wire screen, is then laid on the surface of the dryer, maintaining the bronze screen position to avoid bending or curling the wet tissue. After the tissue has been transferred to the dryer, the tissue is covered with the weighted canvas and dried for one minute at a dryer surface temperature of 212° F. The bronze wire screen is then removed from the tissue. The dried tissue sample represents the tissue web as it was initially formed, with the structural changes associated with creping or embossing having been eliminated.

After relaxation and drying, the tissue sample is placed on a flat surface, such as a table top, in a well-lighted room. Alternatively, the tissue sample can be placed on a lighted table and illuminated from underneath. The lunometer is placed flat on top of the tissue, with the lines of the lunometer positioned parallel to the machine direction of the sample. The lunometer is then slowly moved in the cross-machine direction of the tissue until a pattern of shaded waves appears. For purposes herein, the presence of any such wave pattern is a "positive response" to the Lunometer Test for the chosen direction. In this case, it is a positive response for the machine direction of the tissue, indicating that the tissue contains a pattern of regularly-spaced parallel lines running parallel to the machine direction of the tissue. To determine a diagonal direction Lunometer Index, the same procedure is followed, except the lunometer is rotated from 0° to 90° to either the right or left of the machine direction to align the lunometer lines with a chosen diagonal direction of the tissue. The lunometer is then slowly moved perpendicular to the chosen diagonal direction of the sample. Because the diagonal direction can be anywhere between 0° and ±90°, it may require some trial and error to locate. However, a trained eye will readily detect the diagonal line pattern in most instances. Typically, the diagonal direction will be from about 30° to about 60° to the left or right of the machine direction.

For purposes herein, "tissue" is a creped web suitable for use as a facial tissue, bath tissue, napkins or paper towelling. Uncreped dry basis weights for such webs can be from about 4 to about 40 pounds per 2880 square feet and can be layered or homogenous Creped web densities are from about 0.1 grams to about 0.3 grams per cubic centimeter. Creped tensile strengths in the machine direction can be in the range of from about 100 to about 2000 grams per inch of width, preferably from about 200 to about 350 grams per inch of width. Creped tensile strengths in the cross-machine direction can be in the range of from about 50 to about 1000 grams per inch of width, preferably from about 100 to about 250 grams per inch of width. Such webs are preferably made from natural cellulosic fiber sources such as hardwoods, softwoods and nonwoody species, but can also contain significant amounts of synthetic fibers.

Forming fabrics suitable for making the tissue products of this invention are described in a co-pending application filed of even date in the names of Kai F. Chiu et al. and are manufactured by Lindsay Wire Weaving Company, although the products of this invention can be made by any other suitable fabrics or other forming means which deposit the fibers in the manner herein described. More specifically, such forming fabrics consist of a multi-ply structure having an upper ply of a self-sustaining weave construction, a lower ply also of self-sustaining weave construction, and binder filaments interconnecting the two plies into a unitary structure having controlled porosity to afford drainage of the water from the pulp slurry deposited on the fabric at the wet end of the papermaking machine. Such forming fabrics are characterized by a weave construction in the upper ply which embodies machine direction (MD) filaments disposed in groups such that the spacing between the groups is sufficient to provide a wide drainage channel extending in the machine direction and the spacing between the filaments within the group providing narrow drainage channels also extending in the machine direction. Flow of water through the forming fabric is further controlled by the upper ply in combination with the lower ply, which provides a porous structure underlying the respective channels in a fashion to control the drainage of water through the forming fabric. In a preferred embodiment of such fabrics, the binder filaments between the plies cooperate to maintain the MD filaments of the upper ply within the groupings and cooperate to position the MD filaments in the lower ply between the wide channels of the upper ply to further control the drainage rate of water through the channels. The forming fabric is also preferably provided with at least one diagonal twill pattern on the upper surface which imparts to the sheet being formed on the fabric a detectable appearance of a series of diagonally-extending lines or more than one series of diagonally crossing lines complementary to the machine direction lines provided by the individual optically-densified areas within the sheet, thereby enhancing the cloth-like appearance. Preferably the forming fabric has a top layer mesh (warp yarns of the top layer per inch of width) of about 60 or greater and a top layer count (top layer shute and binder fiber support yarns per inch of length) of about 90 or greater. Most preferably the fabrics have a mesh of from about 70 to about 140 and a count of from about 120 to about 200.

DETAILED DESCRIPTION OF THE INVENTION

Figure 1:
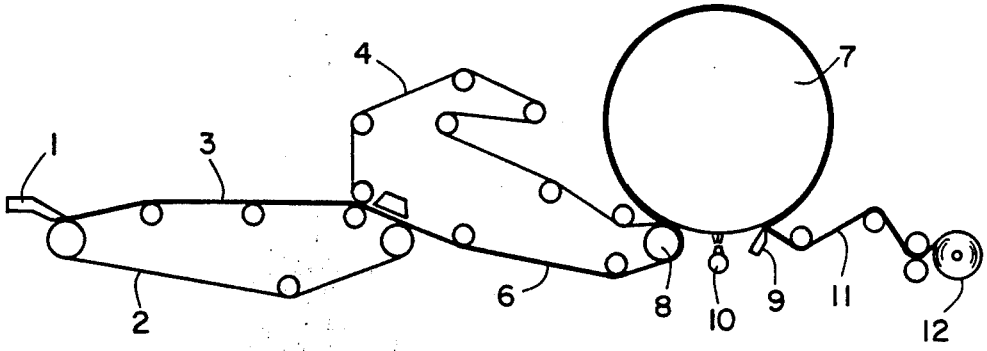
FIG. 1 is a schematic flow diagram of a typical tissue-making process, which is useful for making the tissue products of this invention.

Referring to the Drawing, the invention will now be described in greater detail.

FIG. 1 is a schematic flow diagram of a tissue-making process in accordance with this invention. Shown is the headbox 1 which continuously deposits an aqueous slurry of papermaking fibers onto an endless forming fabric 2 as heretofore described. The water from the slurry is channeled and drained through the forming fabric to form at least one broken line pattern of densified areas containing higher mass concentrations of fibers relative to the balance of the web. The newly-formed or embrionic web 3 is transferred to a felt 4, with or without a pick-up shoe 5, and further dewatered. The dewatered web 6 is then transferred to a Yankee dryer 7 with smooth pressure roll 8 and creped using a doctor blade 9. Creping adhesive is uniformly applied to the Yankee surface with a spray boom 10. Alternative drying methods, such as one or more throughdryers, can be used in place of or in addition to the Yankee dryer. After creping, the creped web 11 is wound onto a parent roll 12 for subsequent converting into facial tissue, towelling and the like.

Figure 2:
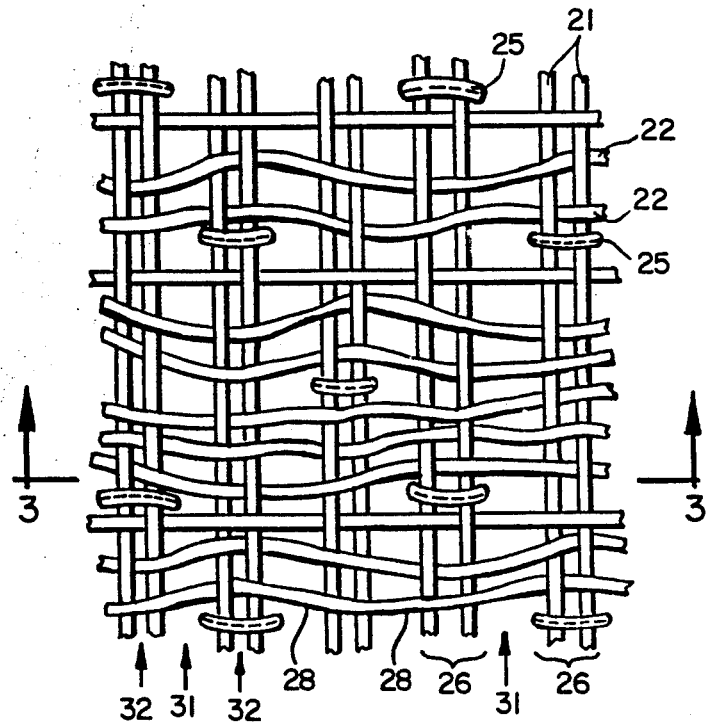
FIG. 2 is a plan view of a forming fabric suitable for use in the manufacture of the tissue products of this invention.
Figure 3:
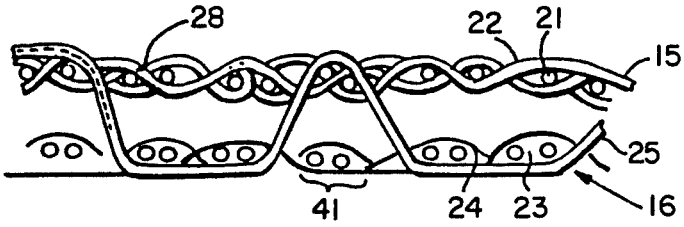
FIG. 3 is a sectional view taken on the line 3—3 of FIG. 2.
Figure 4:
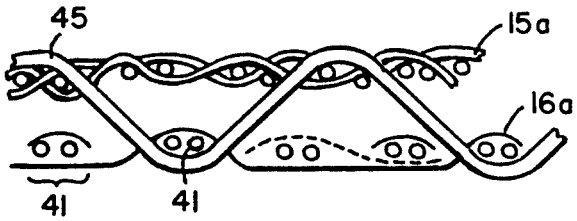
FIG. 4 is a sectional view similar to FIG. 3 showing a suitable modified weave of the forming fabric.

FIGS. 2–4 illustrate with more particularity a suitable forming fabric useful for making the tissue products of this invention. The forming fabric is preferably a so-called 3-ply fabric consisting of an uppermost ply 15 comprising a self-sustaining weave construction having monofilament warp yarns 21 (also referred to as MD filaments) of a given diameter interwoven with shute yarns 22 (also referred to as CD filaments) in a selected weave pattern. The lowermost ply 16 is also constructed of warp yarns 23 and shute yarns 24 in a self-sustaining weave construction. The interconnecting ply comprises binder yarns 25 which are interwoven respectively with the uppermost and lowermost plies to form a composite three-ply fabric.

The upper ply 15 is designed to provide an array of elongated cross-direction (CD) knuckles 28 spanning multiple MD filaments 21 to form a CD knuckle-dominated top surface in an interrupted 3 shed twill pattern (in FIG. 2, an interrupted $1\times2$ twill). As shown in FIGS. 2 and 3, MD filaments 21 comprise monofilaments disposed in relatively straight alignment in groups of two with a narrow channel in between as indicated at 26. The first three top CD filaments 22A, 22B and 22C extend over two adjacent MD filaments 21 and under a third MD filament 21 in a twill pattern. The fourth top CD filament 25 (herein referred to as an integrated binder yarn) follows a twill pattern but is interrupted at alternating knuckle points. It goes over two top MD filaments 21, underneath two pairs of bottom warps 41 and then repeats again over two top MD filaments 21. In taking such a weave path, this CD filament functions as (1) a partial top long knuckle for fiber support, (2) a binder yarn to tie in the top and bottom layers, (3) a grouper yarn to cause the two top warps 21 to twin together and (4) a position yarn to control the location of the bottom warps 41 as in relationship to the wide channel formed by the top layer warps 21 which will be described later. As shown, this weave of the filaments, when woven with normal tension on the filaments in the machine direction, produces a fabric in which the MD filaments 21 are disposed relatively straight and parallel. On the other hand, the CD filaments may be straight 22A and may have a zig-zag pattern 22B, 22C traversing the MD filaments 21. As shown in FIG. 2, the MD filaments 21 are arranged in groups 26 of two so as to provide a relatively wide drainage channel as indicated at 31 between the groups 26 of MD filaments 21, whereas within the group 26, a narrow drainage channel 32 is provided between the MD filaments 21 within the group. The CD knuckles span the wide channels with varying distance between adjoining CD filaments 23.

By reason of this arrangement in the upper ply 15, as the forming fabric travels under the head box at the rate of about 3000 to 6500 feet per minute, the slurry deposited by the head box permits the fiber content of the slurry to be deposited and supported across the CD knuckles, allowing the water of the slurry to be channeled between the MD filaments 21. In view of the larger width of the wide channels 31 relative to the narrow channels 32, the slurry is directed to flow through the wide channels, carrying with it a larger percentage of the fibers for depositing across the knuckles overlying the larger channels. To some degree, fibers will span over the knuckles overlying the narrow channels 32, but the density of the fibers overlying the wide channels will be greater than the density of the fibers overlying the narrow channels. The diagonal pattern of the knuckles provides a relatively uniform supporting grid for the fibers throughout the entire surface area of the forming fabric, but the channels underlying the knuckles afford concentration of the fibers on the surface in MD bands overlying the wide channels.

In the upper ply 15 shown in FIG. 2, the wide channels 31 as seen from the top view are on the order of three times the width of the narrow channels 32. It is believed that the grouping of the MD filaments is effective to provide bands of greater density fiber when the channels 31 are at least 50% larger in width than the channels 32. It is believed that when the wider channels become more than six times the width of the narrow channels, the concentration of fibers in the wider channels will be of such greater density than in the narrow channels as to impair the integrity of the paper. Thus, the range of ratios of the wider channel width to the narrow channel width is believed to fall within the range of 1.5 to 6.

The lowermost ply of the forming fabric cooperates to control the flow of the water from the slurry through the respective wide and narrow channels of the uppermost ply. To this end, the lowermost ply in the present embodiment comprises a $1\times2$ twill pattern in which the warp yarns 23 of the lowermost ply operate in pairs 41 rather than singly. The illustrated arrangement of contacting paired warp yarns in the lowermost ply may be modified by using a single ovate (or so-called flat) warp yarn as described in U.S. Pat. No. 4,705,601, or more than two small round filaments in the lowermost ply to enhance the wear resistance of the fabric without sacrificing fabric thinness.

The weave pattern of the integrated binder yarn 25, which is interwoven with the upper and lower plies, affects the porosity of the composite forming fabric. As shown in FIGS. 2 and 3, the integrated binder yarns 25 are shute yarns which extend in the cross direction and pass through the upper ply and over the warp yarns 21 in the group 26 so as to cooperate to reinforce the grouping of the MD filaments 21 in the upper ply. In FIG. 3, the binder yarn 25 is shown passing under two adjoining pairs 41 of warp yarns in the lower ply before passing upwardly over the group 26 in the upper ply spaced two channels over from the first group 26 over which it passes. As shown in FIG. 3, the binder yarn thereby positions the open channel 33 between the paired MD filaments in the lower ply in vertical registry with the channel 31 in the upper ply to enhance the localized drainage through the forming fabric.

FIG. 4 shows an alternate weave arrangement in which the upper ply 15*a* is identical to the ply 15 of FIG. 3, and the weave of the lower ply 16*a* is identical to the ply 16. In this embodiment of the three-ply fabric, the integrated binder filaments 45 extend under a single pair 41 of MD filaments in the lower ply 16a to offset the upper channel 31 and the lower channel 42 to provide a somewhat different control of the drainage flow through the fabric.

In either case, the control of the drainage through the forming fabric is determined primarily by the channels provided between the groups 26 of warp yarns in the upper ply. The grouping of the warp yarns may be accomplished by suitable selection of weave patterns when weaving the fabric, such that the tensions applied to the warp and shute yarns during the weaving operation control the spacings between the yarns to produce the desired machine direction channels. Since the filaments are normally polyester or nylon, they are heat set to maintain the desired spacing when put onto the papermaking machine. In addition to controlling the spacing by the weave patterns and tensions, the spacing may be controlled by threading the loom for weaving the forming fabric with empty dents in the upper ply between the dents in which the grouped MD yarns 21 are carried. The skilled weave designer can combine various features to provide grouped MD filaments as desired in the forming fabric. Furthermore, the shedding of the fabric may use regular twill shedding or may use atlas shedding, if desired.

In the lowermost ply, the relatively large CD shutes predominate on the machine side of the forming fabric so as to provide wear potential as it travels through the papermaking machine and stability characteristics to minimize wrinkling which permits prolonged use of the forming fabric between replacements.

It is noted that the CD knuckles on the upper surface of the forming fabric predominate by reason of the fact that the MD knuckles are shorter in length and are more deeply embedded in the body of the upper ply. By having the CD knuckles project above the MD knuckles, a twill pattern of CD knuckles is evident from an inspection of the forming fabric. This diagonally-placed pattern of CD knuckles tends to provide a perception of an embossed effect on the sheet formed by the forming fabric which pattern enhances the cloth-like appearance of the tissue sheet material produced by this fabric.

Figure 5:
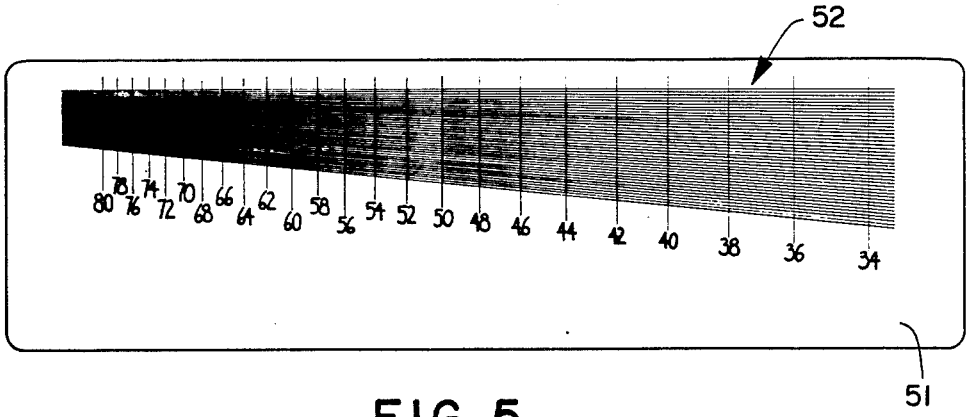
FIG. 5 is a plan view of a lunometer as used herein for determining the Lunometer Index.

FIG. 5 illustrates one type of lunometer used for determining a response to the Lunometer Test and for determination of the Lunometer Index. Shown is a clear rectangular plate 51 containing a series of converging fine black lines 52. In this particular model, the fine black lines converge at one end to effectively change their spacing from one end of the Lunometer to the other. Also shown is a numerical scale, the reading of which determines the Lunometer Index.

Figure 6:
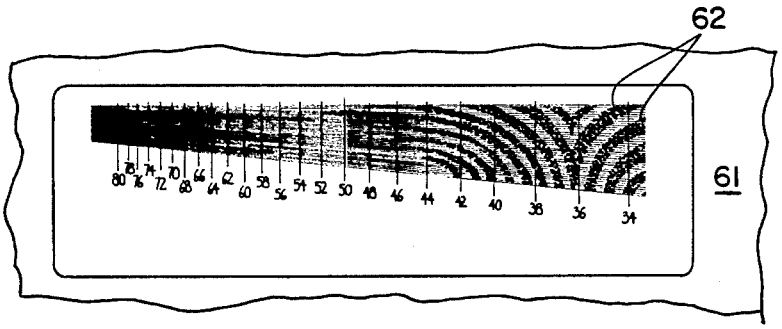
FIG. 6 is a plan view of a lunometer in position over a tissue test sample, illustrating the shape of the interference pattern which indicates a positive response to the Lunometer Test.

FIG. 6 shows the lunometer of FIG. 5 placed on top of a tissue 61 of this invention, illustrating a typical interference pattern. The interference pattern consists of a series of shaded waves 62, the axis of symmetry of which intersects the lunometer's scale at about 37, which is the Lunometer Index for this tissue sample.

Figure 7:
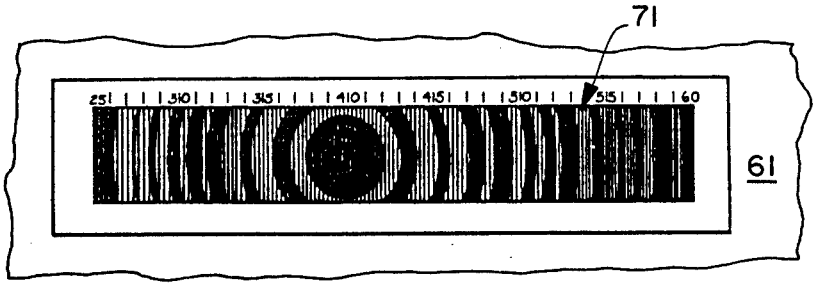
FIG. 7 is a plan view of a different lunometer, illustrating a different interference pattern.

FIG. 7 is similar to FIG. 6, except a different style lunometer is used to elicit the positive response to the Lunometer Test. In particular, this lunometer contains a series of parallel fine black lines 71, the spacing of which decreases from one end of the lunometer to the other. As with the lunometer of FIGS. 5 and 6, a scale is provided to determine the Lunometer Index. As shown, the interference pattern for this style lunometer can be slightly different, depending upon the scale, in that the waves of the interference pattern form segments of concentric circles. The axis of symmetry (the diameter of the circle formed by converging waves) intersects the lunometer scale at the Lunometer Index value. The Lunometer Index value illustrated in FIG. 7 is about 40. Regardless of the shape of the interference pattern, there will always be an axis of symmetry for determing the Lunometer Index value.

Figure 8A:
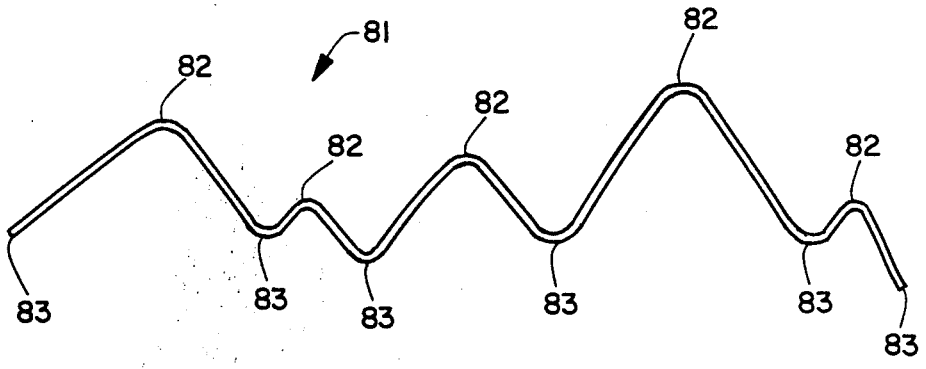
FIG. 8A is a schematic cross-sectional view of a tissue web, as viewed in the cross-machine direction, illustrating a typical crepe structure found in creped tissues.

FIG. 8A represents a cross-sectional view of a typical creped tissue web 81, showing the peaks 82 and valleys 83 of the crepe structure.

Figure 8B:
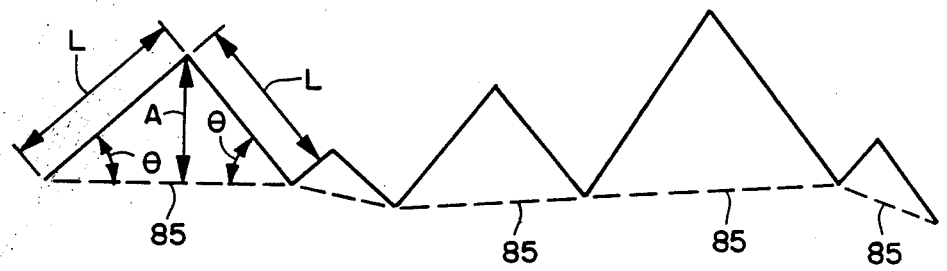
FIG. 8B is an "abutting triangles" simulation of the crepe structure of FIG. 8A, illustrating the meaning of the terms "crepe leg length", "crepe angle", and "crepe amplitude" as used herein.

FIG. 8B shows an abutted triangles simulation of the crepe structure illustrated in FIG. 8A in which the peaks and valleys are connected by straight lines. Each of these straight lines represents a "crepe leg length" and has a length "L". The average value of the individual crepe leg lengths is the crepe leg length for the tissue. In constructing the abutted triangles, the ends of the crepe leg lengths corresponding to the valleys of the crepe structure are connected by dashed base lines 85 to complete each triangle. Each of the two acute angles formed between the crepe leg length and the base lines of each triangle is a crepe angle. The sine function of each crepe angle $\theta$ ($\sin \theta$) is averaged for all the crepe angles of the tissue, which average is reported as $\sin \theta$ or the sine of the crepe angle for the tissue. Similarly, the amplitude "A" of each triangle is the perpendicular distance from the base line of each triangle to the apex formed by adjacent crepe leg lengths as shown. The average of all the crepe amplitudes is the crepe amplitude for the tissue. Standard deviations for each of the crepe characteristics mentioned above represent the variability of individual crepe characteristics from the average and can be determined by averaging values over a representative number of cross-sectional samples. For purposes herein, average values and standard deviations were determined by analyzing about 150 or more individual crepe structures or triangles for each tissue sample. Image analysis techniques are very useful for this purpose, although the calculations can be done by hand if image analysis equipment is not available.

EXAMPLES

EXAMPLE 1:

Production of Facial Tissues

A facial tissue in accordance with this invention was made with the process described and shown in FIG. 1 at a speed of about 2500 feet per minute. The furnish to the headbox consisted of 70 weight percent eucalyptus fiber and 30 weight percent softwood kraft fibers. The forming fabric was a Lindsay Wire Weaving Company CCW (Compound Conjugate Warp) 72×136 forming fabric of the type described in FIGS. 2 and 3. The newly-formed web was transferred to the felt and dewatered to a consistency of about 40 percent before being uniformly adhered to the Yankee dryer with a polyvinyl alcohol-based creping adhesive consisting of about 1–1.5 pounds of polyvinyl alcohol per ton of fiber, about 1 pound of Kymene per ton of fiber, and about 0.5 pound of Quaker 2008M release agent per ton of fiber. The temperature of the Yankee dryer was about 230° F. The dried web was creped, using a creping pocket angle of about 85° and a doctor blade grind angle of about 10° . The resulting web, having a crepe ratio of about 1.45, was wound and converted with two-ply facial tissue having a finished dry basis weight of 9.25 pounds per 2880 square feet per ply.

The resulting facial tissue exhibited a positive response to the Lunometer Test and had a machine direction Lunometer Index of about 40 and a diagonal direction Lunometer Index of about 24. The crepe leg length was 103 micrometers, with a standard deviation of 44. The crepe amplitude was 53 micrometers, with a standard deviation of 18.9. The sine of the crepe angle was 0.55, with a standard deviation of 0.175.

As a control, facial tissue was made with the process described in FIG. 1, except an 80×92 mesh single layer, 3-shed forming fabric was used instead of the Lindsay Wire Weaving Company CCW forming fabric. The resulting tissue did not exhibit a positive response to the Lunometer Test. The crepe leg length was 98.7, with a standard deviation of 38.1. The crepe amplitude was 55 micrometers, with a standard deviation of 21.0. The sine of the crepe angle was 0.60, with a standard deviation of 0.19.

A comparison of the crepe of the control with the product of this invention shows that the product of this invention exhibited a more uniform crepe structure, which is attributable to the regular line pattern of individual densified areas created during the formation of the web.

EXAMPLE 2:

User Preference

Eighty-two premium facial tissue users were recruited by an independent agency to participate in a sight and handling test of the control and invention tissues described in Example 1. They were each given a pair of tissues (one control and one of this invention) which were placed under a box so the user could not see the tissues. The users were asked to feel each tissue and pick the tissue they preferred (tactile-only test). Then the users were handed a new pair of tissues which they could see and feel and were asked which tissue they preferred (tactile and visual test). The results of the tests are tabulated below:

| | User Preference | |
|---|---|---|
| Sample | Tactile Only | Tactile and Visual |
| Preferred Control | 16 | 10 |
| Preferred This Invention | 62 | 65 |
| No Preference | 4 | 7 |

The results clearly show a substantial preference for the product of this invention.

It will be appreciated by those skilled in the art that the foregoing examples are given for purposes of illustration and are not to be construed as limiting the scope of the invention.

We claim:

1. A creped tissue web having at least one broken line pattern of individual optically densified areas containing higher mass concentrations of fibers created during the initial formation of the tissue web, said tissue web exhibiting a positive response to the Lunometer Test for at least the machine direction of the tissue web and having a standard deviation for the sine of the crepe angle of 0.18 or less.

2. The tissue web of claim 1 having a Lunometer Index of about 70 or less for the machine direction of the web.

3. The tissue web of claim 2 having a Lunometer Index of from about 30 to about 65 for the machine direction of the web.

4. A creped tissue web having at least two broken line patterns of individual optically densified areas containing higher mass concentrations of fibers created during the initial formation of the tissue web, said tissue web exhibiting a positive response to the Lunometer Test for the machine direction and a diagonal direction of the tissue web.

5. The creped tissue web of claim 4 having a positive response to the Lunometer Test in two diagonal directions.

6. The creped tissue web of claim 4 having a Lunometer Index of about 70 or less in the machine direction of the web.

7. The creped tissue web of claim 6 having a Lunometer Index of about 60 or less in a diagonal direction of the web.

8. The creped tissue web of claim 7 having a Lunometer Index of from about 15 to about 45 in a diagonal direction of the web.

9. The creped tissue web of claim 4 having a standard deviation for the size of the crepe angle of 0.18 or less.

10. A creped web having an average sine of the crepe angle of from about 0.5 to about 0.6 with a standard deviation of 0.18 or less.

11. The tissue web of claim 10 wherein said web has an average crepe leg length of from about 100 to about 120 micrometers.

12. The tissue web of claim 10 wherein said web has an average crepe amplitude of from about 50 to about 60 micrometers.

13. A method for making a tissue web comprising:

(a) continuously depositing an aqueous slurry of papermaking fibers onto an endless forming fabric comprising warp yarns and shute yarns;

(b) draining water from the slurry through the forming fabric to form a dewatered web wherein the papermaking fibers are retained on the forming fabric in a broken line pattern of individual optically densified areas arranged in broken lines parallel to the machine direction of the web, said broken lines being spaced apart a distance greater than the average spacing of the warp yarns of the forming fabric;

(c) drying the dewatered web; and (d) creping the web.

14. The method of claim 13 wherein the forming fabric has at least 70 top layer warp yarns per inch and wherein the dewatered web has 70 or fewer broken lines of individual densified areas per inch, said broken lines extending in the machine direction.

* * * * *